US011027865B2

(12) United States Patent
Sujith

(10) Patent No.: US 11,027,865 B2
(45) Date of Patent: Jun. 8, 2021

(54) PILL PACKAGING DEVICE

(71) Applicant: Yesudasan Sujith, Shreveport, LA (US)

(72) Inventor: Yesudasan Sujith, Shreveport, LA (US)

( * ) Notice: Subject to any disclaimer, the term of this patent is extended or adjusted under 35 U.S.C. 154(b) by 112 days.

(21) Appl. No.: 16/141,250

(22) Filed: Sep. 25, 2018

(65) Prior Publication Data

US 2019/0092500 A1 Mar. 28, 2019

Related U.S. Application Data

(60) Provisional application No. 62/562,754, filed on Sep. 25, 2017.

(51) Int. Cl.

| | |
|---|---|
| ***B65B 5/10*** | (2006.01) |
| ***B65B 1/10*** | (2006.01) |
| ***B65B 35/08*** | (2006.01) |
| ***B65B 9/02*** | (2006.01) |
| ***B65B 61/02*** | (2006.01) |
| *B65B 61/26* | (2006.01) |
| *B65B 35/56* | (2006.01) |
| *B65B 39/00* | (2006.01) |
| *B65B 35/12* | (2006.01) |

(52) U.S. Cl.

CPC ..... *B65B 5/103* (2013.01); *B65B 1/10* (2013.01); *B65B 9/026* (2013.01); *B65B 35/08* (2013.01); *B65B 61/025* (2013.01); *B65B 35/12* (2013.01); *B65B 35/56* (2013.01); *B65B 39/007* (2013.01); *B65B 61/26* (2013.01)

(58) Field of Classification Search

CPC B65B 5/103; B65B 1/10; B65B 9/026; B65B 35/08; B65B 61/025; B65B 35/12; B65B 35/56; B65B 39/007; B65B 61/26

See application file for complete search history.

(56) References Cited

U.S. PATENT DOCUMENTS

| | | | | |
|---|---|---|---|---|
| 3,245,197 | A * | 4/1966 | Arcudi | B65B 9/042 53/453 |
| 3,545,164 | A * | 12/1970 | Middleton | B65B 5/103 53/446 |
| 4,493,178 | A * | 1/1985 | Buckner | B65B 61/26 53/131.5 |
| 4,831,812 | A * | 5/1989 | Martin Cocher | B65B 9/026 53/176 |
| 6,289,656 | B1 * | 9/2001 | Wangu | B65B 9/02 53/507 |
| 6,519,914 | B1 * | 2/2003 | Pesho | B65B 9/02 53/134.1 |
| 9,394,070 | B2 | 7/2016 | Pearson et al. | |
| 2004/0111277 | A1 * | 6/2004 | Pearson | B65B 61/26 705/2 |
| 2006/0161293 | A1 * | 7/2006 | William | G07F 17/0092 700/216 |

(Continued)

*Primary Examiner* — Nathaniel C Chukwurah
*Assistant Examiner* — Lucas E. A. Palmer
(74) *Attorney, Agent, or Firm* — Holoubek Patent Law, LLC; Charles G. Holoubek

(57) ABSTRACT

A pill packaging device comprising a pill encloser, a pill dispenser mounted to the pill encloser, and a pill funnel, which routes pills from the pill dispenser to the pill encloser. The pill packaging device may include rolls of first and second packaging film mounted to first and second film mounts, a pill carrousel, a printer, a barcode scanner, and seal jaws.

20 Claims, 11 Drawing Sheets

(56) References Cited

U.S. PATENT DOCUMENTS

| | | | | |
|---|---|---|---|---|
| 2011/0113727 | A1* | 5/2011 | Bonner | B65B 43/267<br>53/266.1 |
| 2014/0096479 | A1* | 4/2014 | Pearson | B65B 39/007<br>53/131.4 |

* cited by examiner

PILL PACKAGING DEVICE

CROSS REFERENCE TO RELATED APPLICATIONS/PRIORITY

The present invention claims priority to U.S. Provisional Patent Application No. 62/562,754 filed Sep. 25, 2017, which is incorporated by reference into the present disclosure as if fully restated herein. Any conflict between the incorporated material and the specific teachings of this disclosure shall be resolved in favor of the latter. Likewise, any conflict between an art-understood definition of a word or phrase and a definition of the word or phrase as specifically taught in this disclosure shall be resolved in favor of the latter.

BACKGROUND OF THE INVENTION

There are many pharmacies, hospitals, and Long Term Care facilities where it is desired to individually package unit doses of medications. This is accomplished by placing the medication (normally in pill, tablet or capsule form and hereinafter the term "pill" shall mean any of tablet, capsule, caplet, geltab, gelcaps, and other forms of oral solid medication) in packaging such as a strip packages and heat seal the package. Pill packaging machines such those described in U.S. Pat. Nos. 4,493,178 and 9,394,070 are presently employed to place unit doses of medication into individual packages. These two patents are incorporated by reference into the present disclosure as if fully restated herein. Any conflict between the incorporated material and the specific teachings of this disclosure shall be resolved in favor of the latter.

Current pill packaging technology suffers from deficiencies of, amount other things, pill crushing, pill tracking, and pill package identification. Though there is a long felt need for addressing these problems, no solution has yet been presented by those of ordinary skill in the art. For the foregoing reasons, there is a pressing, but seemingly irresolvable need for an improved pill packaging machine.

SUMMARY OF THE INVENTION

Wherefore, it is an object of the present invention to overcome the above mentioned shortcomings and drawbacks associated with the current technology. The present invention is directed to methods and apparatuses that satisfy the above shortcomings and drawbacks. The pill packaging device methods and apparatuses preferably comprise a pill dispenser, a pill encloser, and a pill funnel. The pill funnel may be positioned between the pill dispenser and the pill encloser and comprises a body having inlet and outlet. In traversing from the pill dispenser the pill enters the pill funnel inlet, travels through the pill funnel, exits the pill funnel outlets, and continues into the pill encloser. The pill funnel outlet has a long axis of preferably between about 50 mm and about 10 mm and a short axis of preferably between about 20 mm and about 5 mm, and outlet apertures. The long and short axis are perpendicular to one another and, when the pill funnel is mounted in the pill encloser, the long and short axes preferably lie in a plane perpendicular to the horizontal. The pill preferably travels through the pill funnel and exits the outlet aperture oriented such that the pill lies down horizontally.

A sensor is preferably positioned proximate to or between the pill funnel and the pill carousel to detect a pill dropping into or through the pill funnel causing the pill carousel assembly to dispense a next pill or not dispense the next pill based upon programing including whether the sensor detects a pill.

A further embodiment of the pill packaging device includes a pill dispenser comprising a pill pan with preferably concentrically mounted pill carousel, with the pill carousel having circumferentially positioned pill apertures (also called pill slots). The pill apertures may be pill shaped (as shown) and/or oval, square, rectangular, diamond, triangular, tear dropped, and circular shaped, for example, and different sizes, for example.

According to a further embodiment, the pill packaging device includes the pill funnel (also called a pill guide body) preferably having a length of between about 25 mm and about 100 mm, and more preferably having a length of about 50 mm.

According to a further embodiment, the pill packaging device includes a printer to print label information, including, for example, a barcode, on a pill package (also called a pill pouch) formed by the pill packaging device, and a barcode scanner positioned to read the barcode on the pill package while the pill package is being formed by the sealing jaws. It is to be understood that a barcode may include both linear and matrix or 2D barcodes, and future optical, machine-readable, representations of data.

According to a further embodiment the pill packaging device includes lengths of first and second packaging film fed through a set of sealing jaws and a film advancing mechanism pulling the lengths though the sealing jaws. A controller controls the film advancement mechanism, pill dispenser and the sealing jaws. An input device preferably receives information identifying a pill type. The controller is programmed to operate the film advancement mechanism to pull a length of film corresponding to a pill package length associated with the pill type.

The pill packaging device preferably includes a printer capable of printing a barcode on the film. Preferably at least one jaw from the set of sealing jaws is heated and seals the lengths of the first and second film along three sides to form a rectangular pill package.

A database preferably associates a unique identifier number for a particular pill with a package size.

The input device preferably includes at least one of a barcode scanner, a touch screen, a camera and a keypad. The pill type is preferably determined from numerical information located on a pill supply container.

The pill packaging device preferably includes a printer that prints pill identification information, such as a barcode, on at least one of the lengths of film forming a package.

The pill encloser preferably includes a barcode scanner positioned to read the barcode printed on the pill package while the pill package is being formed by the sealing jaws. Upon detection of an unreadable barcode, for example, the controller may cease operation of the pill packaging device and generate an error message for an operator. Additionally or alternatively, upon detection of an unreadable barcode, the controller may generate a message for an operator specifying the packages with non-readable barcodes.

The pill packaging device further comprises a film advancing mechanism including a pull motor.

The pill packaging device preferably comprises a pill dispenser, a pill encloser including lengths of first and second packaging film fed through a set of sealing jaws and a film advancing mechanism pulling the lengths though the sealing jaws, and a controller controlling the film advancement mechanism and the sealing jaws.

The pill packaging device according to a further embodiment preferably comprises a pill dispenser, including a pill carousel having pill aperture positioned circumferentially around the disk; a pill encloser including lengths of first and second packaging film fed through a set of sealing jaws and a film advancing mechanism pulling the lengths through the sealing jaws; and a controller controlling the film advancement mechanism and the sealing jaws and which communicates with a database of pill information.

Other embodiments have a built in computer with memory and a microprocessor, preferably solid state drive, a display, DC motors. Other embodiments, as a safety feature, do not have a physical start button on the exterior of the housing, but do have a physical pause button and/or stop button—to start must run program through external or built in computer.

Various objects, features, aspects, and advantages of the present invention will become more apparent from the following detailed description of preferred embodiments of the invention, along with the accompanying drawings in which like numerals represent like components. The present invention may address one or more of the problems and deficiencies of the current technology discussed above. However, it is contemplated that the invention may prove useful in addressing other problems and deficiencies in a number of technical areas. Therefore the claimed invention should not necessarily be construed as limited to addressing any of the particular problems or deficiencies discussed herein.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. It is to be appreciated that though FIGS. 2-9 of the accompanying drawings are drawn to scale, other embodiments may vary in scales and measurements of the various elements, and the emphasis is instead placed on illustrating the principles of the invention. The invention will now be described, by way of example, with reference to the accompanying drawings in which.

DETAILED DESCRIPTION OF THE PREFERRED EMBODIMENTS

Figure 1:
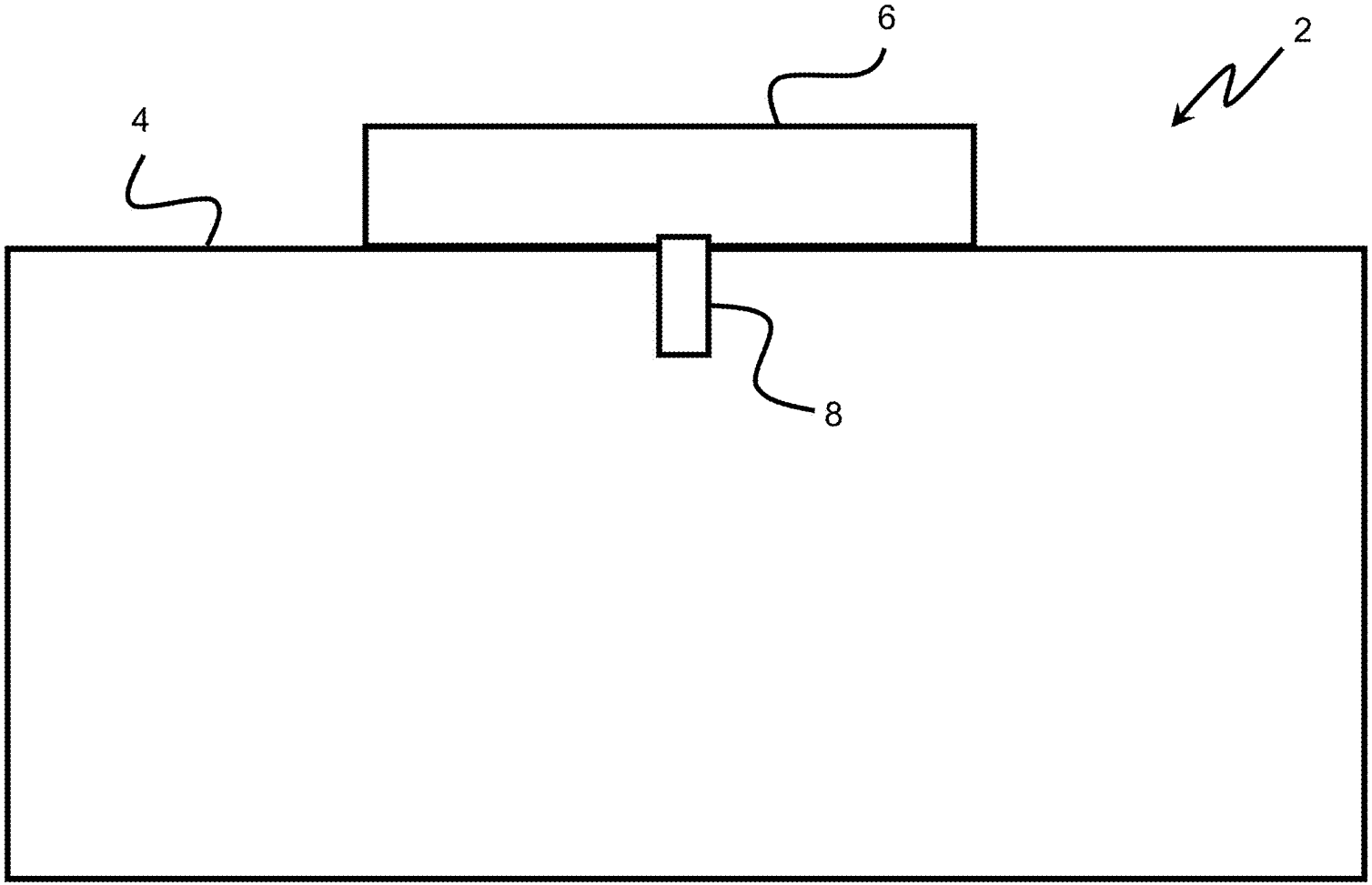
FIG. 1 is a symbolic view of the pill packaging device according to a first embodiment of the presently claimed invention.

The present invention will be understood by reference to the following detailed description, which should be read in conjunction with the appended drawings. It is to be appreciated that the following detailed description of various embodiments is by way of example only and is not meant to limit, in any way, the scope of the present invention. In the summary above, in the following detailed description, in the claims below, and in the accompanying drawings, reference is made to particular features (including method steps) of the present invention. It is to be understood that the disclosure of the invention in this specification includes all possible combinations of such particular features, not just those explicitly described. For example, where a particular feature is disclosed in the context of a particular aspect or embodiment of the invention or a particular claim, that feature can also be used, to the extent possible, in combination with and/or in the context of other particular aspects and embodiments of the invention, and in the invention generally. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm. The embodiments set forth the below represent the necessary information to enable those skilled in the art to practice the invention and illustrate the best mode of practicing the invention. In addition, the invention does not require that all the advantageous features and all the advantages need to be incorporated into every embodiment of the invention.

Turning now to FIGS. 1-11, a brief description concerning the various components of the present invention will now be briefly discussed. As can be seen in FIG. 1 embodiment, the invention relates to methods and pill packaging devices 2.

The pill packaging device 2 preferably includes a pill encloser 4, a pill dispenser 6 positioned above the pill encloser 4, and a pill funnel 8 which assists the routing of pills 10 from the pill dispenser 6 to the pill encloser 4. The pill dispenser 6 preferably rests upon an upper housing cover 12 of a pill encloser housing 14.

In addition to the embodiments of pill dispensers 6 described in the following paragraphs and shown in FIGS. 2-8, for example, other pill dispensers are contemplated, including those disclosed in U.S. Provisional Patent Application No. 62/563,152 filed Sep. 26, 2017, which is incorporated by reference into the present disclosure as if fully restated herein. Any conflict between the incorporated material and the specific teachings of this disclosure shall be resolved in favor of the latter.

Figure 2:
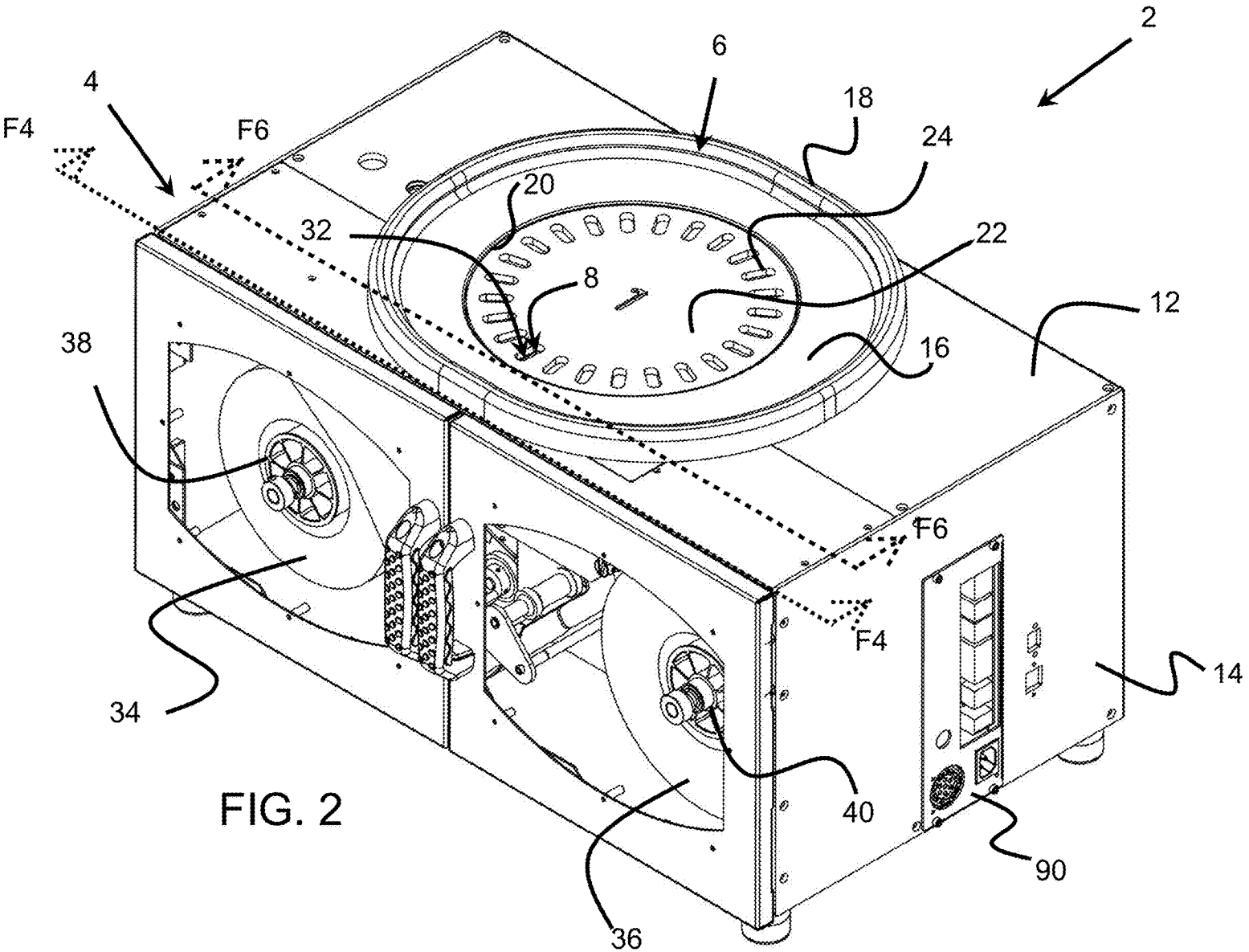
FIG. 2 is an isometric view of the pill packaging device of FIG. 1.
Figure 3:
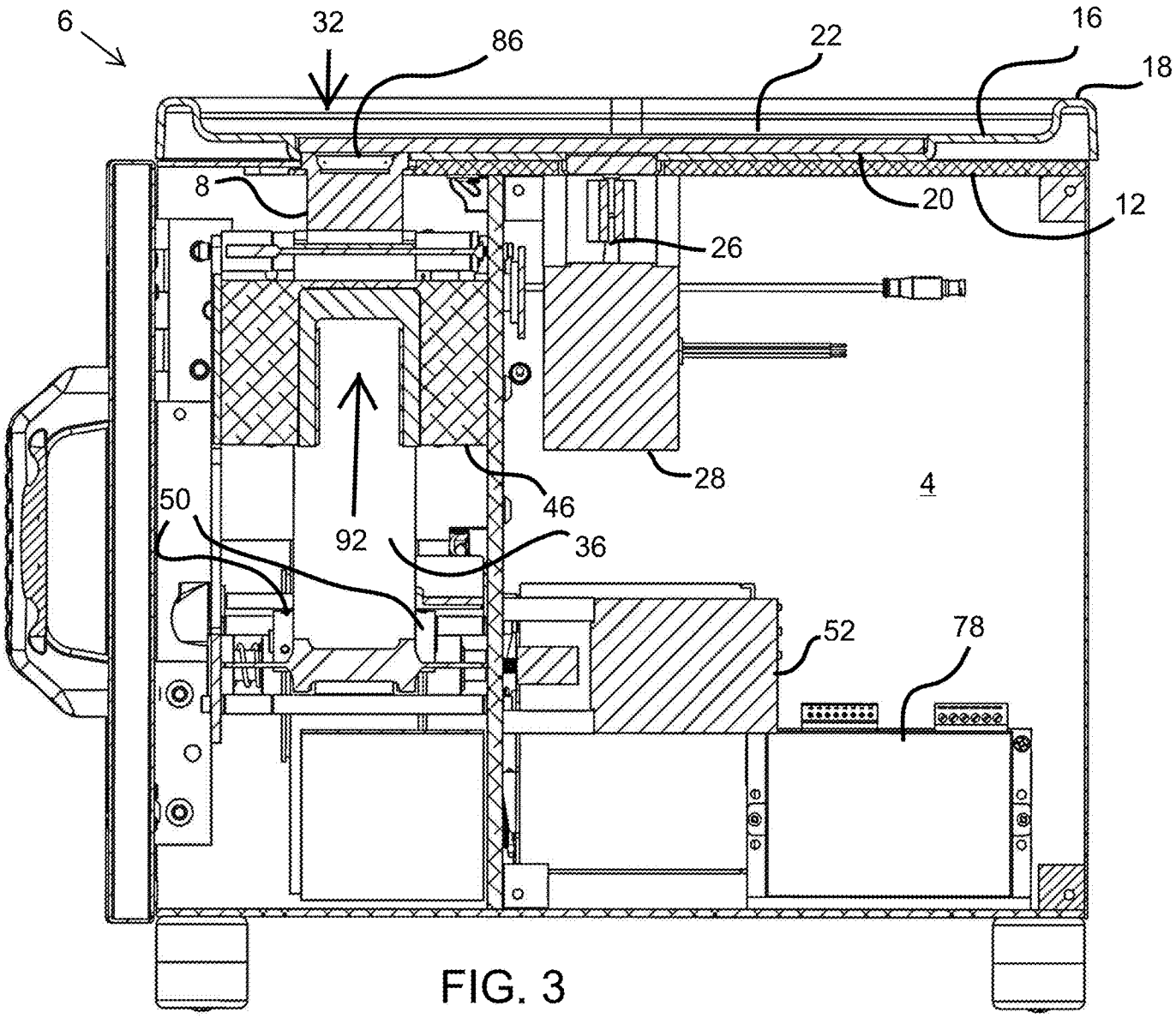
FIG. 3 is a sectional view of the pill packaging device of FIG. 2, along the section line F3 in FIG. 4.
Figure 4:
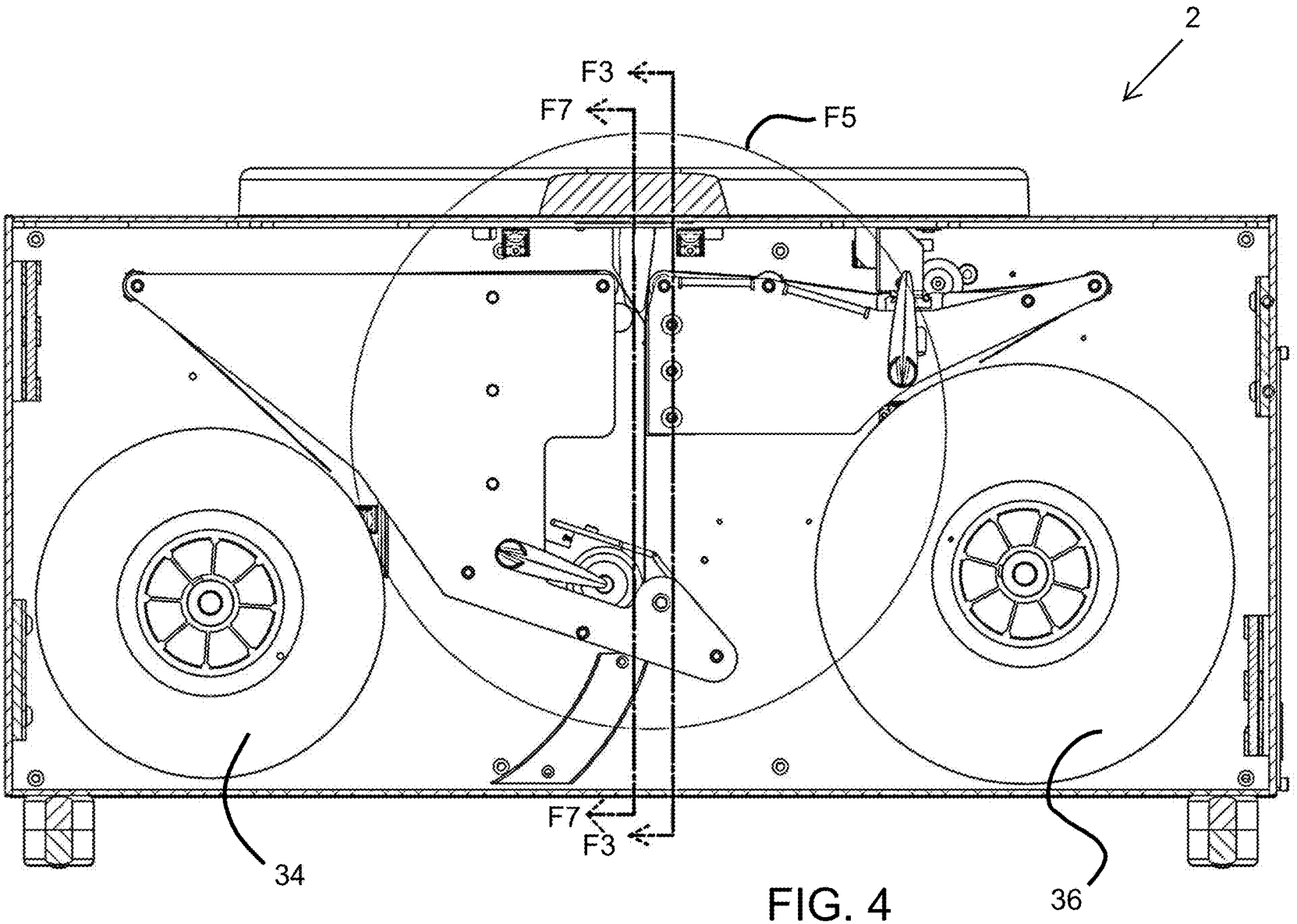
FIG. 4 is a sectional view of the pill packaging device of FIG. 2, along the section line F4 in FIG. 2.
Figure 5:
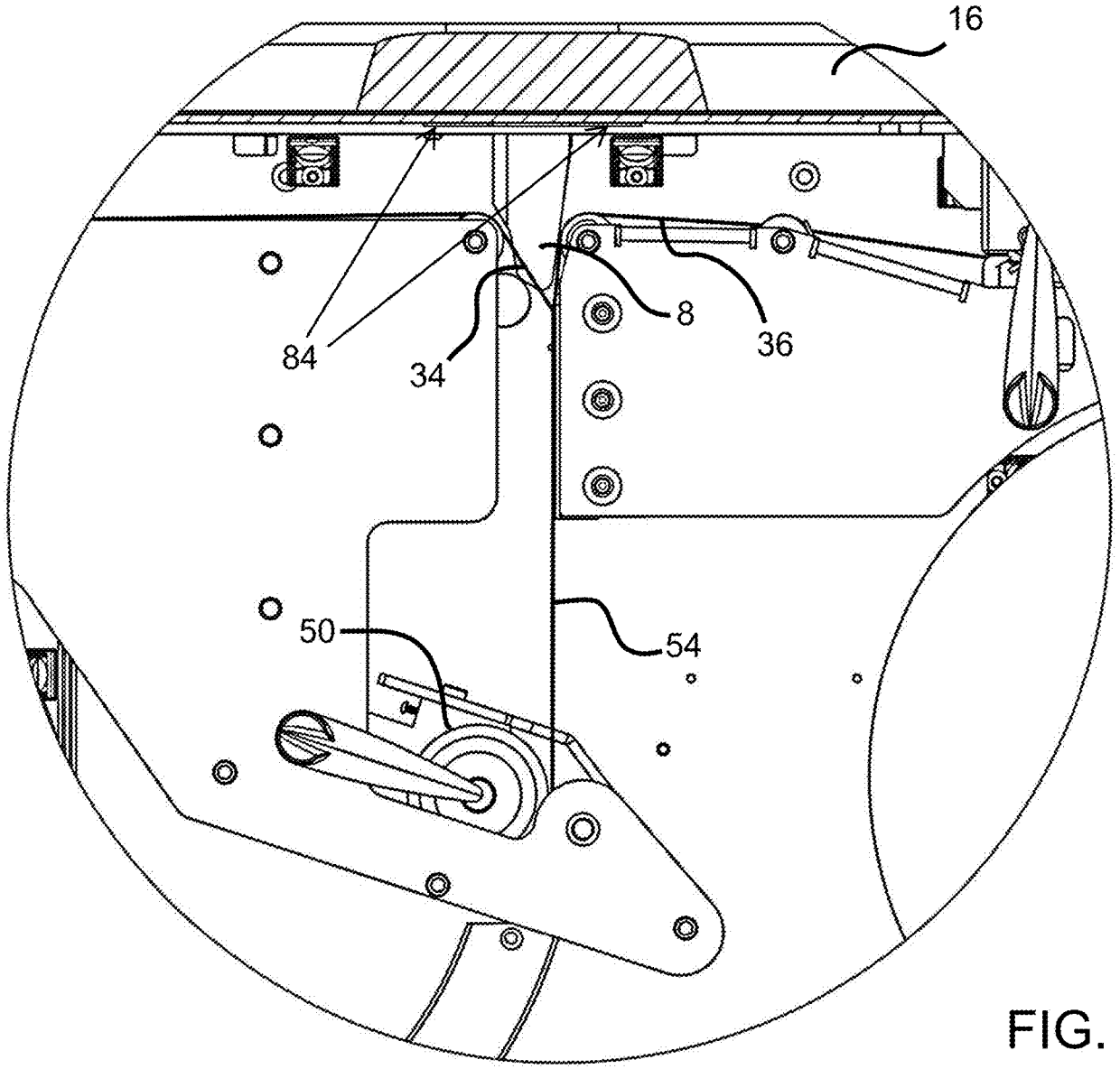
FIG. 5 is an up close view of the circular area marked F5 in FIG. 4.

In the pill dispenser 6 shown in FIG. 2, the pill dispenser 6 includes pill tray 16 having raised borders 18 help keep pills inside in case of misplacement. The pill dispenser 6 also has a center depression 20 to accommodate a pill carousel 22. The pill carousel 22 is disk shaped with a series of pills apertures 24 formed in a circle along the circumference of the pill carousel 6.

A carousel motor shaft 26 of the carousel motor 28 (alternatively called the dispensing motor 28) extends through upper housing cover 12 and is keyed to engage the pill carousel, preferably at a shaft head receiver 30. The carousel motor 28 will rotate the pill carousel 22, but preferably not the pill tray 16, and successively bring each of the pill apertures 24 into alignment with a funnel aperture 32 formed in both the upper housing cover 12 and the pill tray 16, and then deposit a pill 10 in the pill funnel 8.

Figure 6:
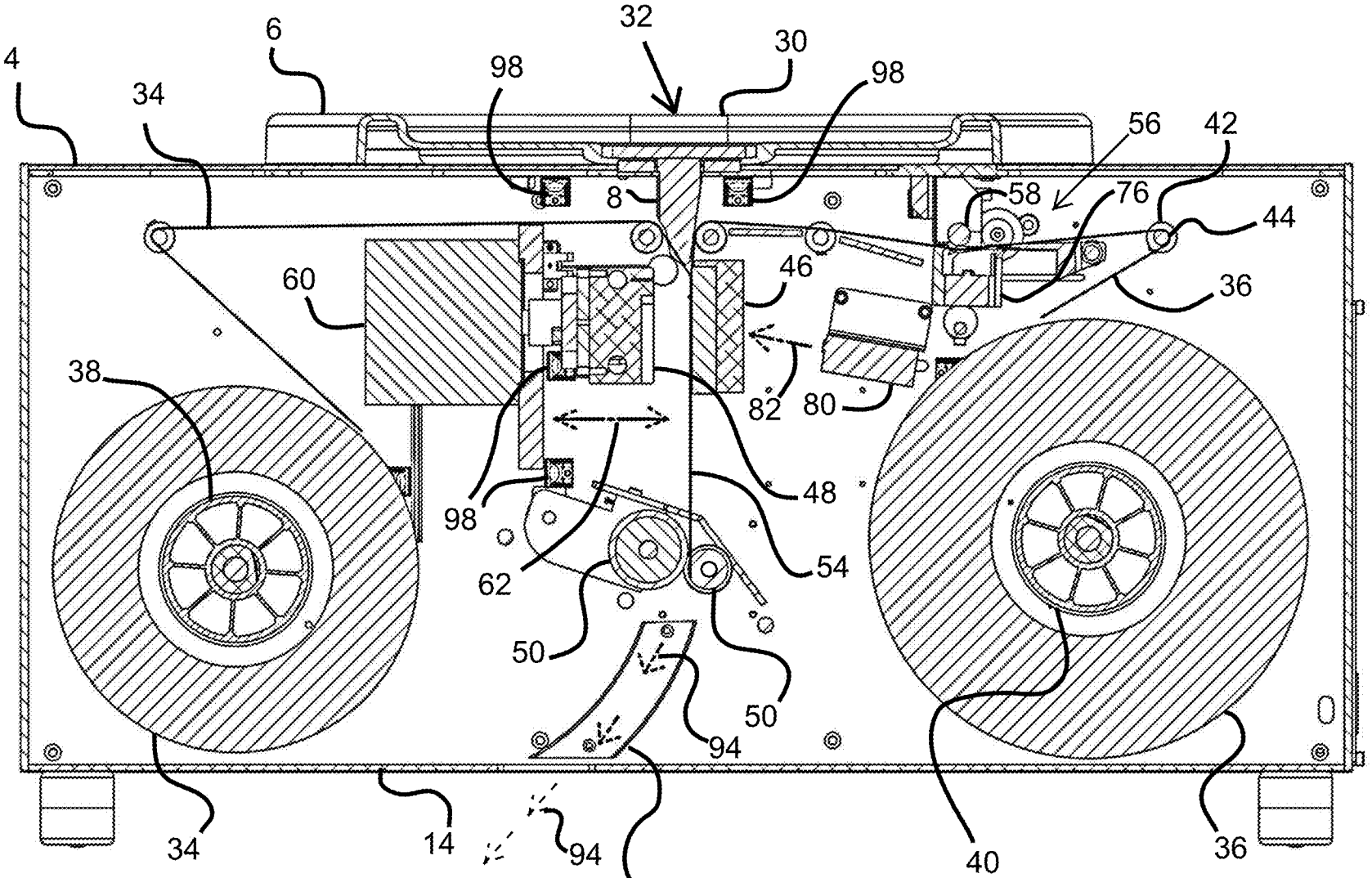
FIG. 6 is a sectional view of the pill packaging device of FIG. 2, along the section line F6 in FIG. 2.

The embodiment of pill packaging device 2 shown in FIGS. 2-11 is a two-film packaging machine 2. Rolls of first and second packaging film 34, 36 are positioned on respective first and second film mounts 38, 40 on opposing sides of the housing 14. A series of roller frame members 42 secure various rollers 44 within the housing 14 of the pill encloser 4. In FIG. 6, the first and second packaging films 34, 36 extend respectively from the first and second film mounts 38, 40 across a series of guide rollers 44, past sealing jaws 46, 48, and then downward to be engaged by pull wheels 50, which are powered by a pull motor 52. Pull wheels 50 will grip the two films 34, 36 (now formed into packages 54 by sealing jaws 46, 48) and pull the joined film segments 54 from the rolls of the first and second packaging film 34, 36 through the encloser. A printer area motor 56 imparts rotation to printer rollers 58, pulling the second packaging film 36 preferably 10-100 milliseconds before the pull motor 52 imparts rotation on the pull wheels 50. Control of the pull motor 52 allows for control of the packaging film 34, 36 being drawn through the packaging machine 4. In one example, the first packaging film 34 is a transparent, cellophane based film and second packaging film 36 is paper foil film capable of accepting printed characters from a conventional printer. Both films may be available from suppliers such as Oracle Packaging Inc.

At initial power up of the pill packaging device 2, the moving seal jaw is pushed forward by the seal motor enough to move the moving seal jaw away from the seal home sensor and then slowly pull motor pulls the moving seal jaw back until the seal home sensor triggers.

The major components of sealing jaws 46, 48 are seen in FIG. 6. The U-shaped stationary seal jaw 46 opposes the U-shaped moving seal jaw 48 and it will be understood that when the two seal jaw members 46, 48 come together, the two packaging films 34, 36 will be pressed together, preferably heated, and will be sealed between the seal jaws 46, 48. Though not shown, both of the seal jaws 46, 48 may be moving seal jaws 48. In the embodiment illustrated, the moving seal jaw 48 is connected to a heating source which raises the moving seal jaw 48 to a temperature sufficient to melt together and seal the two films 34, 36. In other embodiments, the stationary seal jaw 46 may alternatively or additionally be heated by a heating source. The seal jaws 46, 48 may be heated internally or externally.

FIG. 6 also shows the seal motor 60, a stepper motor in this embodiment, which, in a reciprocating motion 62, first pushes the moving seal jaw 48 to move toward the stationary seal jaw 46 until the moving seal jaw 48 reaches its maximum extension (in other embodiments a seal jaw cam may be used), at which point the two packaging films 34, 36 are pressed together by the two seal jaws 46, 48 and make a seal along the path of the U-shaped seal jaws 46, 48 to create a single package 54. Then the seal motor 60 moves the moving seal jaw 48 away from the stationary seal jaw 46 to a point of maximum retraction, and the cycle may start again. Additionally, a perforation blade may be positioned on one or both of the sealing jaws. When the jaws engage, the perforation blade can cut a series of perforations in the films 34, 36, thereby forming a tear line for easier separation of individual packages 54.

It will be further understood that in the embodiment shown, the U-shaped jaw members 46, 48 seal the packaging film 34, 36 along three sides of a rectangle, the two vertical sides and a horizontal side. The horizontal seal portion acts both as a top horizontal sealed section for current seal package 54 formed below the horizontal seal, and as a bottom sealed section for a next seal package 54 being formed above the horizontal seal. The vertical sides form the sides of the current seal package 54, though they may extend vertically below the current seal package 54 and overlap the previous seal package 54. As the film 34, 36 is advanced, the next package 54 being formed likewise has a bottom section, but the top and sides remain open to receive a pill 10 falling through the pill funnel 8. Once a designated pill or pills 10 have been deposited in the unsealed package 54, the seal jaws 46, 48 close again providing upside down U shape seal for the package 54. When the seal jaws 46, 48 separate, the package 54 is then pulled downward a predefined distance such that the top sealed section becomes the bottom seal for the subsequent individual pill package 54. While the width of the individual pill packages 54 may be controlled by the packaging film 34, 36 width, the height or length (and therefore the "size" or volume) of the individual pill packages 54 may be controlled by the length of packaging film 34, 36 drawn past the seal jaws 46, 48 between closing cycles of the seal jaws 46, 48.

Figure 7:
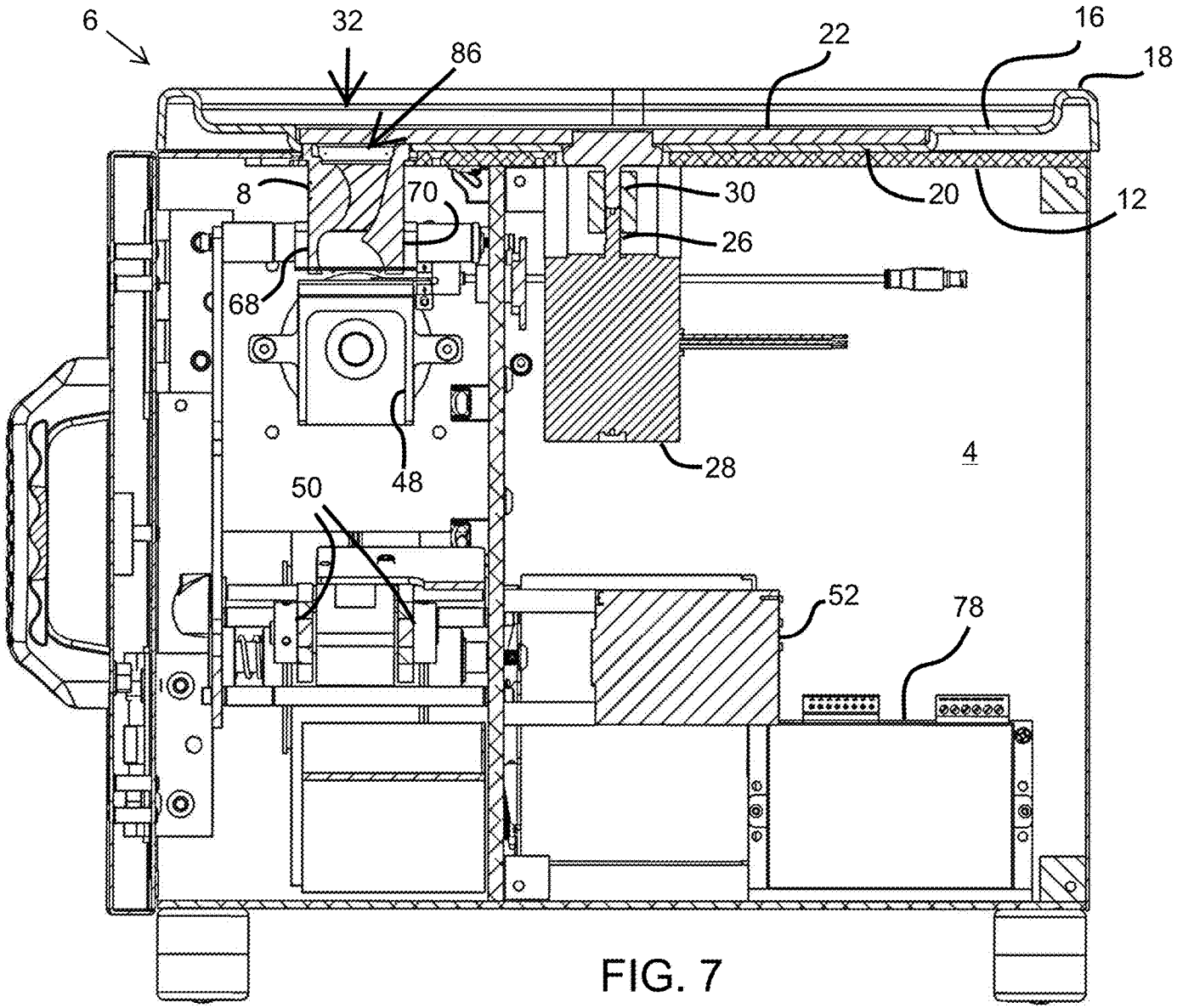
FIG. 7 is a sectional view of the pill packaging device of FIG. 2, along the section line F7 in FIG. 4.
Figure 8:
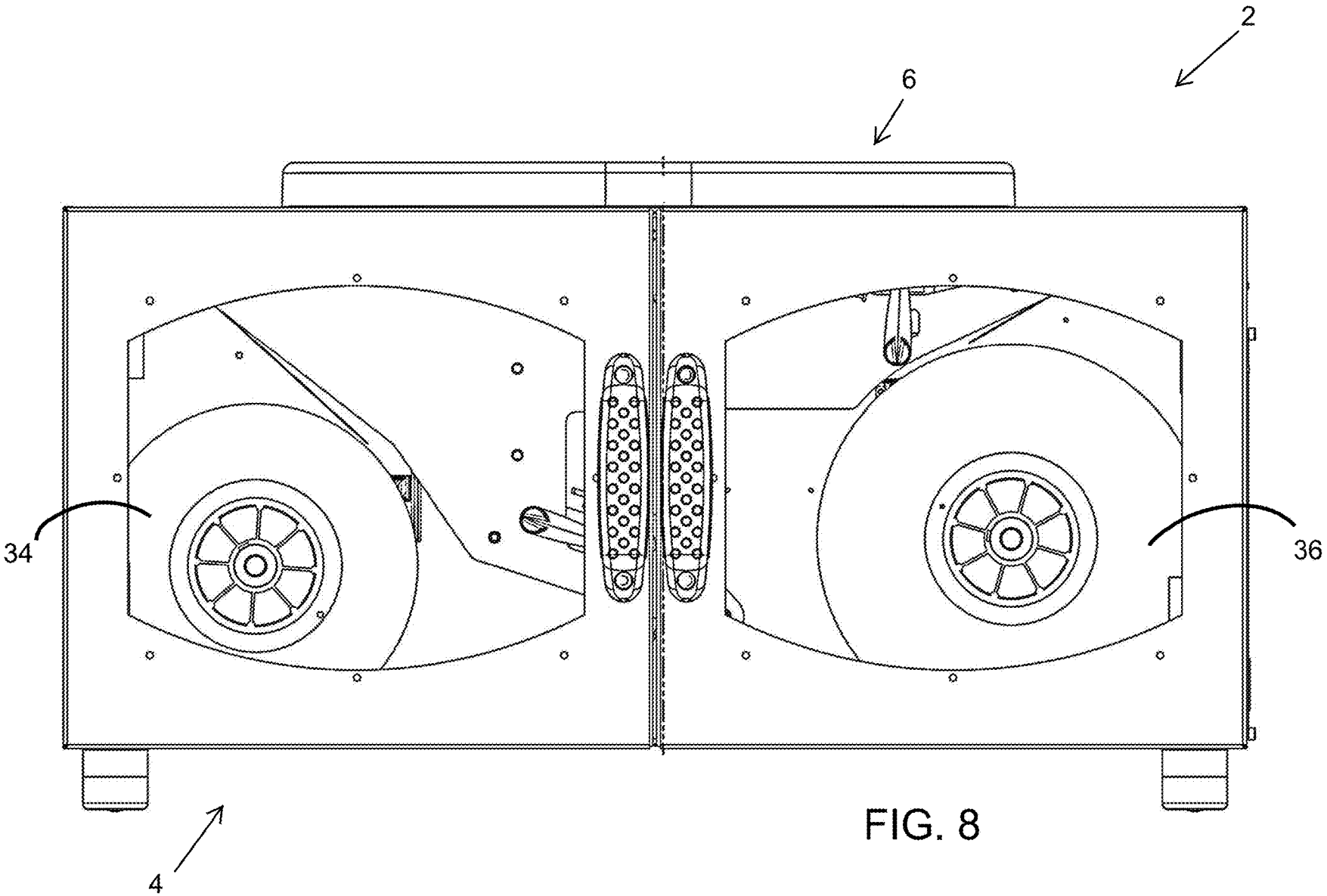
FIG. 8 is a front plan view of the pill packaging device of FIG. 2.
Figure 9:
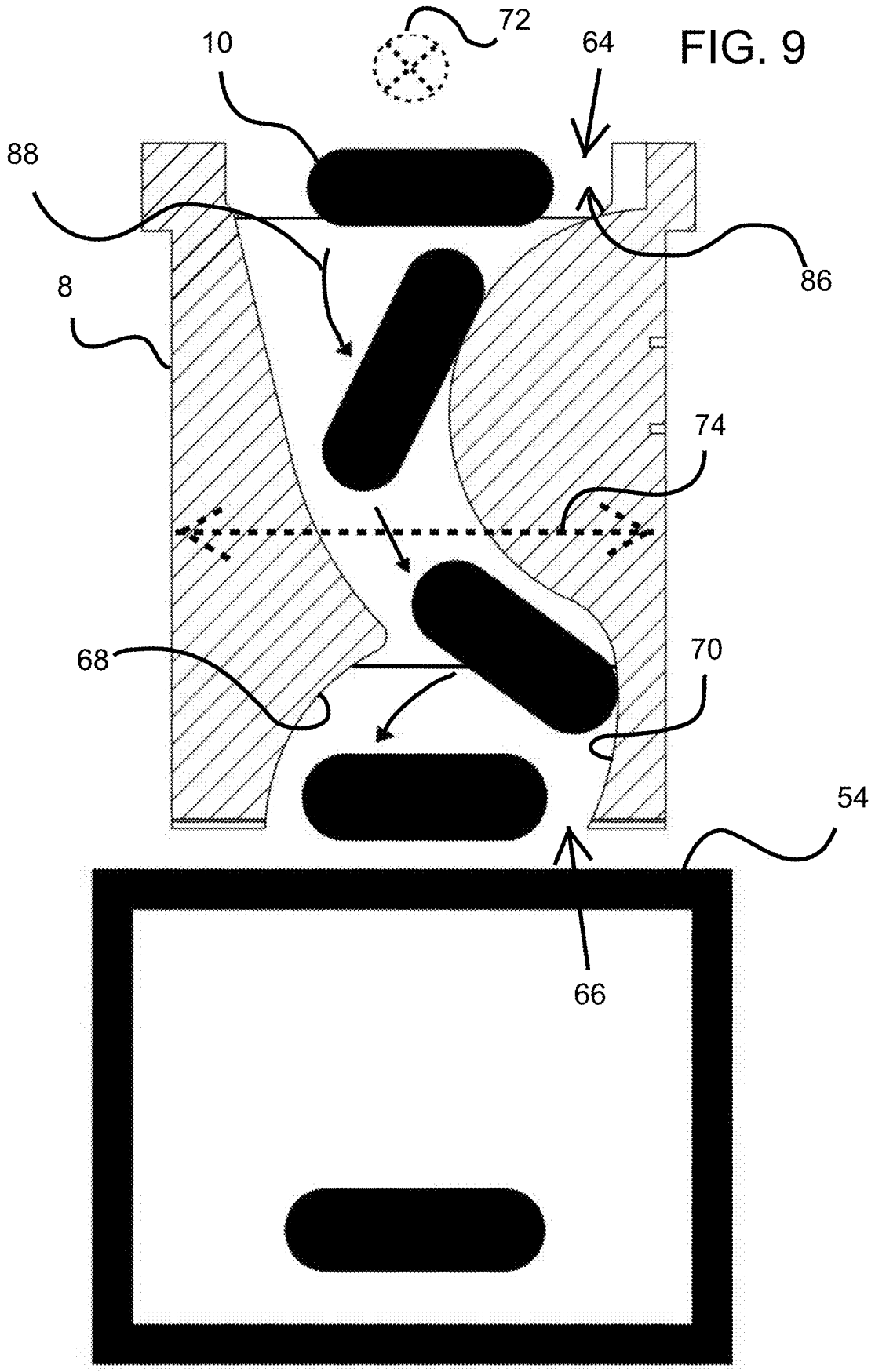
FIG. 9 is a sectional view of the pill funnel, as sectioned in FIG. 7, also showing the path of a pill falling through the pill funnel and the general orientation of the pill when in a just sealed pill package.

In the embodiments illustrated, the pill funnel has an inlet 64 and an outlet 66 that are both elongated and generally oval in shape. The pill funnel has first and second legs 68, 70 adjacent to and at least partially defining the outlet 66. Preferably each leg 68, 70 of the pill funnel 8 is of the same length, as shown in FIGS. 7 and 9, for example. In certain embodiments, the inlet has a long axis 72 of between about 10 mm and about 50 mm and a short axis 74 of between about 5 mm and about 20 mm. The outlet preferably has a long axis 72 of between about 10 mm and about 50 mm and a short axis 74 of between about 5 mm and about 20 mm. In many embodiments, the overall length of the pill funnel, the length being measured perpendicular of both the short axis 72 and the long axis 74, is between about 25 mm and about 100 mm, and more preferably, between about 40 mm and about 60 mm.

In a preferred embodiment, the printer 76 may be an Epson printer, but any conventional or future developed printer which can perform the functions described herein may be acceptable. While the content and form of information printed on a pill package 54 can vary in different applications, one preferred embodiment will print a uniform product code (UPC) number and/or barcode on the individual pill package 54. Typically, the UPC will include a National Drug Code number, i.e., a 10-digit, 3-segment numeric identifier assigned to each medication listed under Section 510 of the US Federal Food, Drug, and Cosmetic Act and assigned by the US Food and Drug Administration (USFDA). Other information printed on pill packages 54 may include drug name, dosage, expiration date, and picture and/or other physical description of the pill. It will be understood that a device controller 78 can direct the printer 76 to print on the package 54 any combination of information found in a pill information database associated with the pill packaging device 2 (which described in more detail below). A barcode scanner 80 is positioned within the housing 14 of the pill encloser 4. It can be seen that barcode scanner 80 is oriented toward a back side of the second packaging film 36, which is the same side on which printer 76 will have preferably printed product information on packaging film 36—the right or outer side of the second packaging film 36 as oriented in the embodiment shown in FIG. 6 as the package 54 is scanned 82. In one embodiment, the barcode scanner 80 is a Winson model WDI1000-SRTTL.

A beam detector of a pill sensor 84 registers when a light beam of the pill sensor is momentarily broken by a pill 10 passing the plane of the guide window 86 of the pill funnel (a plane passing through the guide window and being generally perpendicular to the vertical fall direction of the pill). Though the guide window 86 is shown to be at the pill funnel inlet 64, with the light beam traveling substantially parallel with the short axis 72, the guild window 86 may be located in the pill funnel 8 at other positions along the pill path 88 as the pill 10 falls through the pill funnel 8, including at or around the middle of the pill path 88, and/or at or around the funnel outlet 66. Additionally or alternatively, the pill sensor 84 and guide window 86 may be oriented such that the light beam travels substantially parallel with the long axis 74, or some axis at an angle between the long axis 74 and the short axis 72 to detect the pill 10.

Additionally, the beam detector of the pill sensor 84 can detect a pill jam at the guide window 86 when the beam remains broken. In one embodiment, the pill sensor 84 is an F&C sensor FFT-25ML. While the illustrated embodiment employs a laser or other light emitting sensor 84, alternative pill 10 detecting pill sensors 84 may include a reflecting, diffusing, or vision sensor, or any other conventional or future developed sensor which may detect a pill 10 passing though pill funnel 8.

Figure 11:
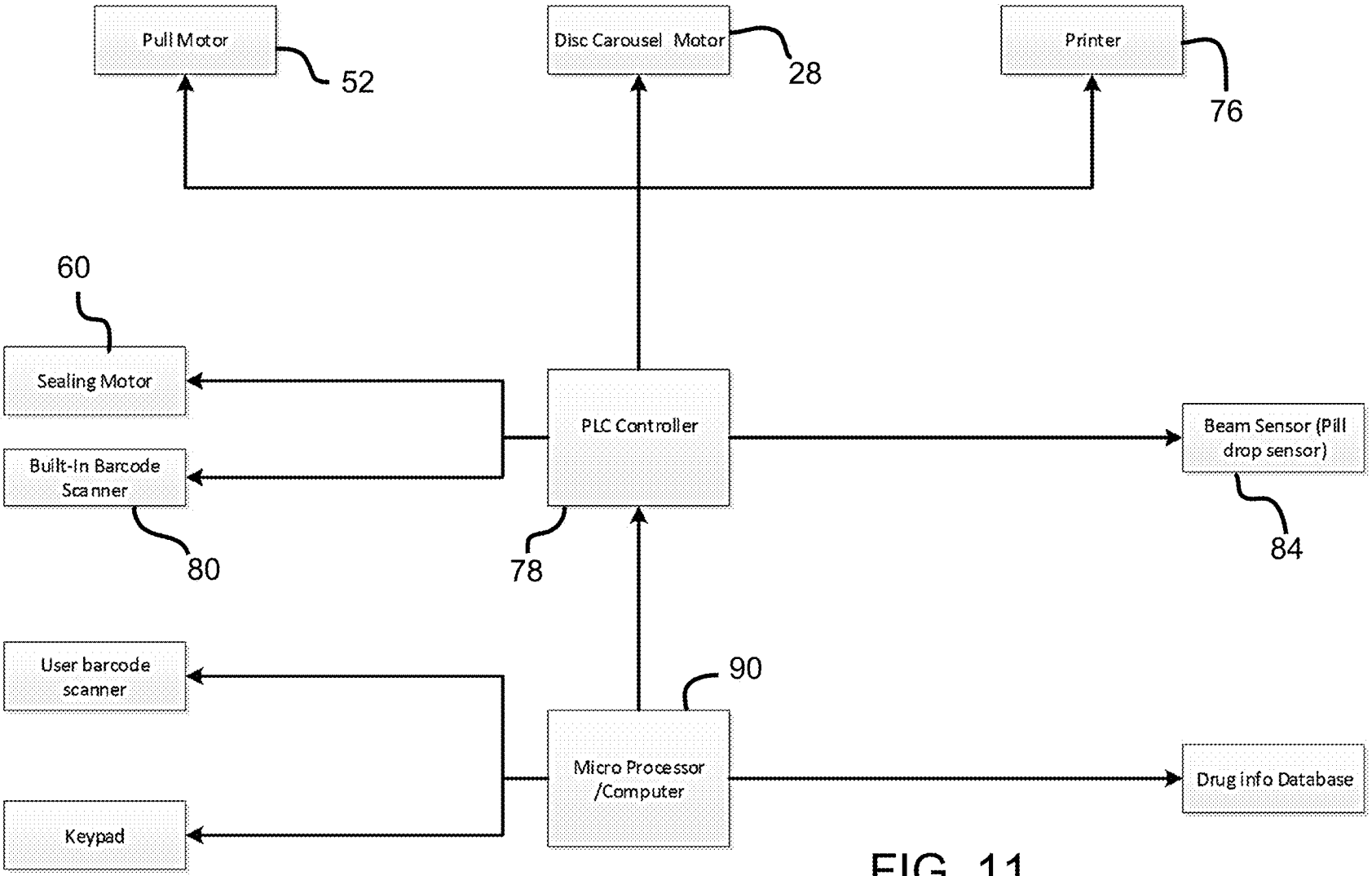
FIG. 11 is a chart that illustrates how the electronic components of one embodiment of the presently claimed packaging device will send information to a controller and/or receive instructions from the controller.

FIG. 11 generally illustrates how the electronic components described above will send information to a controller 78 and/or receive instructions from the controller 78. The controller will typically be a device such as Tri-PLC Model No. SmartTile, but may be any conventional or future developed control circuitry including microprocessors. Likewise, the functions performed by the electronics described herein may be implemented with a conventional software platform such as Tbasic ladder logic PLC program. A user barcode scanner may be included, such as a scanner fixed to the encloser housing or a hand-held scanner connected to the PLC controller.

Several illustrated components use microprocessor functionality 90 in order to operate and such components will preferably communicate with controller 78 via microprocessor 90. Thus, a keypad may (mechanical or touchscreen) communicate with the controller 78 and service as an additional or alternative user input device. The controller 78 may communicate (via microprocessor 90) with a database which may include information for the pill packaging device 2 to function as described herein. Nonlimiting examples of some types of data stored in database includes: a library of National Drug Code designations and drug information associated therewith; information on preferred package 54 sizes to be associated with pills 10 identified with an NDC designation (and corresponding barcode); a drug's generic name and trade name; the strength or dose per pill 10 being packaged; form of the drug (pill, capsule, etc.), the drug manufacturer; the manufacturer expiration date and lot number; control symbols; customer lot number; facility name; label preparer's name and date label is prepared; an image of the pill 10, description of the markings on the pill 10; controlled drug symbols, rules regarding package life, and any description or miscellaneous information the user may choose to input into the database or print on the package 54 (assuming sufficient space exists on the package). The packaging device 2 may also have wired or wireless communication components, such that the device may receive data and instructions from remote locations over a network, or from other devices attached to the packaging device. In one embodiment, the packaging device may be monitored and controlled by a user's mobile device, such as a tablet, lap top, or smart phone, via direct wireless communication such as blue tooth or WiFi, for example, or indirect wireless communication through the internet, including communicating through a third party computer or server.

Figure 10:
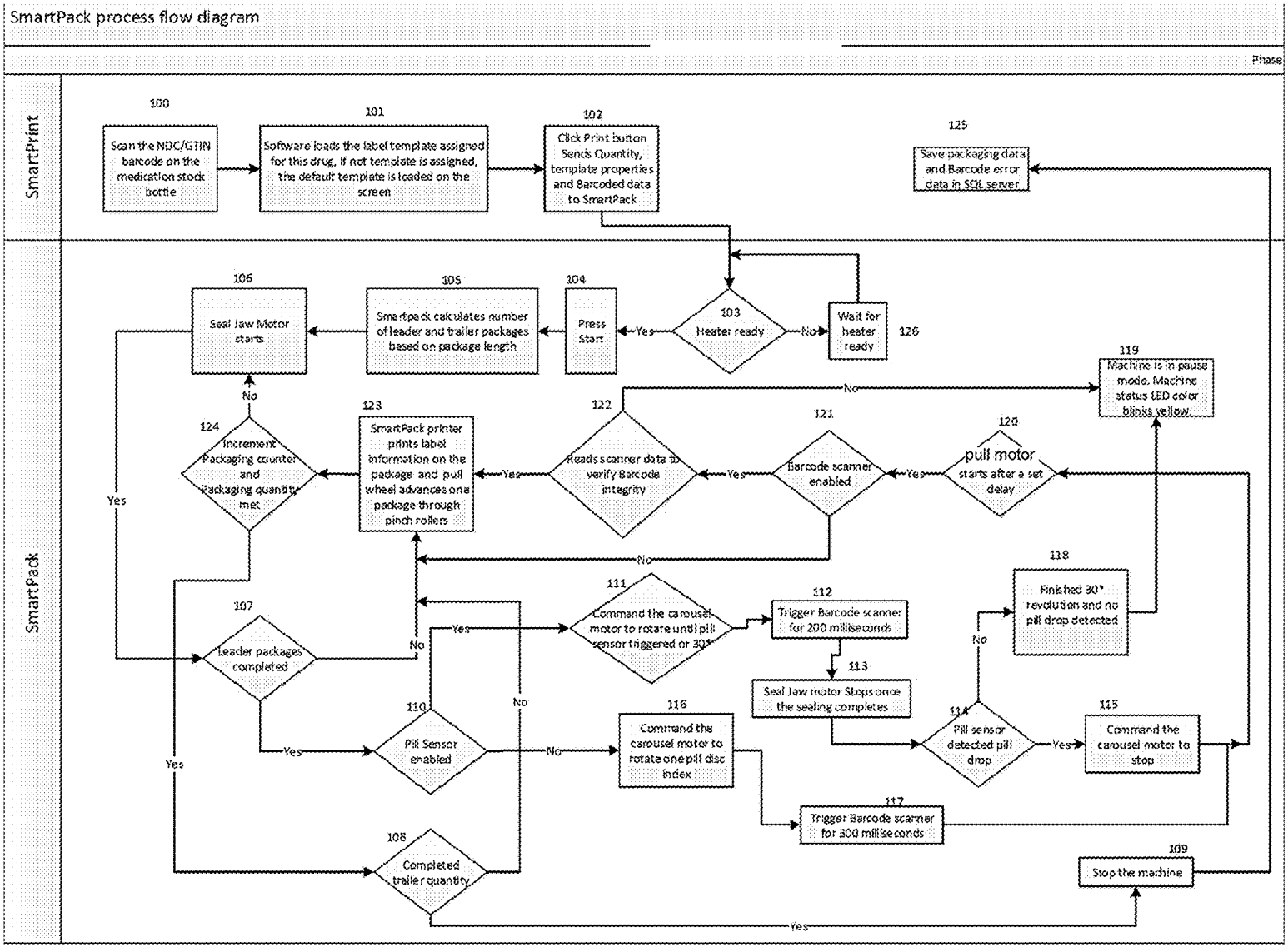
FIG. 10 is a flow chart of one embodiment of the process of pill packaging with the pill packager.

While the programmable nature of the controller 78 allows the pill packaging device 2 to function in many different manners, one example of the pill packaging device's 2 functionality is described in reference to the flow chart in FIG. 10. In this embodiment, the user scans the barcode of the medication stock bottle to initiate the packaging process (step 100). In step 101 the software associates the drug identified in Step 100, via that drug's barcode, with drug information in the database, and then populates the template fields with information available in the database. The user may be required to enter other information (e.g., through keypad) such as the number of pills 10 to be packaged. The pill packaging device 2 may also provide information regarding the size of individual pill packages 54 in terms of the package height. In one example, the database associates a package size with each pill type within the database. After the pill type is identified in step 101, the controller 78 is able to determine the appropriate package 54 size or height for use by controller 78 in operating pull motors 52, sealing jaws 46, 48, and other components whose timing and operation relate to the package 54 size.

Once the correct package label template is selected, understanding that the "label" may just be one side of the second packaging film 36 that forms an outside of the package 54, for example, and once the package 54 size determined, and the drug label information is completed, then the user may send this information to the pill packaging device 2 and packager printer 76 by clicking the Print button (Step 102), which may be located external to the packaging device 2, or on the pill enclosure housing 14.

If the heater associated with sealing jaws 34, 36 is ready (step 103), the user may engage the start button (step 104) to initiate the packaging run, the start button may be located external to the packaging device 2, or on the pill enclosure housing 14. The controller 78 calculates the number of "leader packages" in step 105 based upon package height (i.e., the length of film between the sealing jaws 46, 48 and the printer 76 defined in terms of a number of packages 54 which cannot be properly labeled since this section of packaging film 34, 36 is beyond the printer 76 and is essentially wastage). In step 106, the seal jaw motor 60 which pushes the U-shaped moving seal jaw 48 to move toward the U-shaped stationary seal jaw 46 until the moving seal jaw 46 reaches its maximum extension at which point the first and the second packaging films 34, 36 are pressed together and make a seal along the path of the U-shaped seal jaws 46, 48 to create a single package 54. The device controller 78 checks if the pill packaging device 2 has cycled sufficient times to complete the production of the calculated number of leader packages 54 in step 107. If not, then the packager printer 76 and pull wheels (also called pull rollers) 50 cycle again in step 123. If the calculated number of leader packages 54 have been completed in step 107, and if the pill sensor 84 has been activated in step 110, then the carousel motor 28 (also called the index motor) is activated in step 111 causing the pill carousel 22 (also called a pill disk) to advance until the earlier of (a) the pill sensor 84 detecting a pill 10 dropping through the pill funnel (also called the pill guide) 8 or (b) until the carousel motor shaft 26 makes one complete revolution in step 118 (and in which case the packaging device 2 pauses in step 119), the barcode scanner is triggered in step 112, and the seal jaw motor stops after a delay in step 113. If the pill drop sensor 84 detects a pill 10 dropping then the package printer 76 and pull rollers 50 cycle again in step 123.

In contrast to current practice in the art, the printer 76 on the pill packaging device 2 preferably prints a different trailer image than on pill containing packages 54. The trailer image could be a default trailer image or customized image on the trailer packages 54 to distinguish between packages 54 with pills 10 and without. The trailer image could be a bitmap, a custom image, a standard empty package 54 image, data regarding the specific order, could print patient info, warning info for medicine, dosage info, drug interaction information or allergy information. Different trailer packages 54 of the same order could have the same or different images.

The barcode scanner 80 preferably scans for the printed barcode through an inner cutout window 92 of the stationary seal jaw 46. This is in contrast to current practice in the art that scans after the sealing is done. By instead scanning through seal jaws 46, 48 it saves space and is a faster process without sacrificing efficacy. It shortens the machine and runs faster allowing for more pills to be packaged per minute.

The pull wheels 50 flip open for easy threading of the packaging film 34, 36. The pull wheels 50 are oriented at an angle to the horizontal to allow for faster exit of the pills packages on the package exit path 94 through a package exit channel 96, abrogating the need for a separate pill pusher to get pills out of funnel. In the embodiment shown, only the larger pull wheel 50 that is elevated above the horizontal is powered by the pull motor 52. In other embodiments the other pull wheel 50 may be powered, or both pull wheels 50 may be powered.

Preferably other sensors 98 are present to monitor the progress of the packaging device. This includes, for example, film sensors 98 before the packaging film 34, 36 encounters the pill funnel 8, a seal home switch sensor 98 to detect the seal head location, and a package sensor 98, for inspecting the packages 54 after being sealed.

The printer 76 may print safety info on the pill package 54, for example an image of the pill(s) that are actually supposed to be in the package.

An advantage of one embodiment of the pill funnel 8 is that when the pill 10 falls through the pill funnel 8 it rests/centers between the two legs 68, 70 at the pill funnel outlet 66. As shown in FIG. 7, with the distance between the funnel legs 68, 70 in the long axis 72 being narrower than the distance of the pull wheels 50 and the vertical sides of either seal jaw 46, 48, this greatly aids in preventing pill crushing from the seal jaws 46, 48 or the pull wheels 50. Additionally, because the pill funnel 8 orients the pills 10 to be horizontal/flat as they exit the funnel outlet 66, this allows the pills 10 to load quickly and uniformly into the pill package 54. If the pill 10 was standing or oriented incorrectly in the package 54, it would extend toward the top of the package 54 or to the side of the package 54 and would increase the chances that the seal jaws 46, 48 could crush the pill.

Additional sensors may detect if feed or packaging is broken during process by detecting lack of material. The packaging device 2 may further include a vision sensor camera to compare the image in the database to what is inside the pill package 54 or that is being loaded into the package 54. The sensor could also look at from the top to make sure that only one pill 10 (or the desired number of pills) is going into a package 54 and that it is the correct pill 10. The sensor could look for size, shape, color, and/or imprint and compare that to what is in the database or onboard memory.

In further embodiments, the pill dispenser 6 could have a scale under the carousel that automatically weighs the pills 10 that are loaded and divides by the number of pills 10 loaded to derive at a per pill weight. The microprocessor 90 could compare the derived value with the database for what the specific pills 10 are supposed to weigh and issue a warning if the values do not match, or could automatically stop loading pills 10 and require user override. The pill dispenser 6 could use the weight change as pills are being loaded to ensure that one and only one pill is being loaded at a time (or two or three pills, for example, if that is the desired number of pills to load).

This device can be a compact unit dose packager with multiple package sizes and all features. This makes the device easy for anyone in the pharmacy to install or exchange with a loaner unit, which gives this device an advantage over other table top packagers. This pill packaging device preferably weighs only 50 lbs when fully assembled so anyone can lift this device easily.

This device can record video of all packaging runs for auditing purpose. For example, the most recent 30 videos and/or 30 twenty-four hour days of video may be stored in the computer for troubleshooting the device performance, as well as quality & accuracy of the packaging.

Further embodiments have a cutter that cuts the packages 54 preferably after the pull wheels 50 but before the packages leave the pill encloser 4.

The invention illustratively disclosed herein suitably may explicitly be practiced in the absence of any element which is not specifically disclosed herein. While various embodiments of the present invention have been described in detail, it is apparent that various modifications and alterations of those embodiments will occur to and be readily apparent those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items while only the terms "consisting of" and "consisting only of" are to be construed in the (imitative sense.

Wherefore, I claim:

1. A pill packaging device comprising:

a pill encloser;

a pill dispenser mounted to the pill encloser;

a pill funnel, which routes pills from the pill dispenser to the pill encloser; and an inner cutout window of a stationary seal jaw through which a barcode scanner scans for a printed barcode.

2. The pill packaging device of claim 1 wherein the pill funnel has two legs extending downward from a pill funnel body.

3. The pill packaging device of claim 2 wherein the two legs are of equal length.

4. The pill packaging device of claim 2 wherein the pill funnel has interior contours defining a pill path through the pill funnel, whereby a falling oblong shaped pill will be oriented with an oblong axis of the pill being parallel with a horizontal axis when the pill exits the pill funnel outlet.

5. The pill packaging device of claim 2 wherein the two legs are spaced apart at a closer distance than both two vertical arms of a seal jaw on the pill enclosure and two coaxial pull wheels.

6. The pill packaging device of claim 1 further comprising a guide window defined as a downward concavity in an upper perimeter inlet of the pill funnel.

7. The pill packaging device of claim 6 further comprising a pill sensor attached to the pill encloser and aligned with the guide window to detect pills entering the pill funnel passing by the guide window.

8. The pill packaging device of claim 1 further comprising a pull wheel that pulls sealed packages through the pill packaging device.

9. The pill packaging device of claim 1 wherein a mounting axis of a first set co-axial pull wheels is arranged above a mounting axis of a second set of pull wheels.

10. The pill packaging device of claim 9 further comprising a pill package exit path through a package exit channel that causes the packages of pills to exit at between 75 degrees and 25 degrees to a horizontal axis.

11. The pill packaging device of claim 1 further comprising first and second packaging film mounts which support rolls of first and second packaging film respectively.

12. The pill packaging device of claim 11 further comprising a printer that prints on the second packaging film before the first and second packaging films are sealed to form a package.

13. The pill packaging device of claim 12 further comprising the barcode scanner oriented to read barcodes as the first and second packaging films are being sealed to form a package.

14. The pill packaging device of claim 12, wherein a printer roller pulls at the second packaging film between 10 milliseconds and 100 milliseconds before a pull motor imparts rotation on pull wheels, the pull wheels positioned to pull the first and second packaging films after the first and second packaging films are sealed to form packages.

15. The pill packaging device of claim 1, wherein the pill dispenser further comprises a pill tray that remains stationary with respect to a pill encloser housing, and a pill carrousel that rotates with respect to the pill encloser housing.

16. The pill packaging device of claim 15, further comprising a plurality of pill apertures defined in the pill carrousel.

17. The pill packaging device of claim 16 further comprising a single funnel aperture defined in the pill tray that is oriented vertically above an inlet of the pill funnel.

18. The pill packaging device of claim 1 further comprising a moving sealing jaw with a substantially inverted U face, the moving sealing jaw sealing a first and a second packaging film into a package.

19. The pill packaging device of claim 18, wherein the moving seal jaw is moved by a seal motor, the moving seal jaw is heated, and the stationary seal jaw is positioned between the barcode scanner and the moving seal jaw, with the barcode scanner being substantially horizontally aligned with the moving seal jaw and the stationary seal jar.

20. A pill packaging device comprising:

a pill encloser;

a pill dispenser mounted to the pill encloser;

a pill funnel, which routes pills from the pill dispenser to the pill encloser;

the pill funnel having two legs extending downward from a pill funnel body;

the two legs being of equal length;

a guide window defined in the pill funnel;

a pill sensor attached to the pill encloser and aligned with the guide window to detect pills passing through the pill funnel by the guide window interior contours in the pill funnel defining a pill path through the pill funnel, whereby a falling oblong shaped pill will be oriented with an oblong axis of the pill being parallel with a horizontal axis when the pill exits the pill funnel outlet;

first and second packaging film mounts which support rolls of first and second packaging film respectively;

a moving seal jaw with a substantially inverted U face;

a seal motor which moves the moving seal jaw in a reciprocal direction, the moving sealing being heated to seal the first and second packaging film together to create packages;

a stationary seal jaw which supplies opposing force to the moving seal jaw;

an inner cutout window defined within the stationary seal jaw through which a barcode scanner scans for a printed barcode;

a printer that prints on the second packaging film before the first and second packaging films are sealed to form the package;

the barcode scanner oriented to read barcodes as the first and second packaging films are being sealed to form the package;

a printer roller pulls at the second packaging film between 10 milliseconds and 100 milliseconds before a pull motor imparts rotation on pull wheels, the pull wheels positioned to pull the first and second packaging films after the first and second packaging films are sealed to form packages;

the pull wheels including a first and a second set of co-axial pull wheels, a mounting axis of the first set co-axial pull wheels being arranged above a mounting axis of the second set of pull wheels;

a pill package exit path through a package exit channel that causes the packages of pills to exit at between 75 degrees and 25 degrees to a horizontal axis;

a pill tray that is mounted on and that remains stationary with respect to a pill encloser housing;

a pill carrousel that rotates with respect to the pill encloser housing;

a plurality of pill apertures defined in the pill carrousel;

a single funnel aperture defined in the pill tray that is oriented vertically above an inlet of the pill funnel; and the two legs of the funnel are spaced apart at a closer distance than both two vertical arms of the moving seal jaw and either the first or the second set of co-axial pull wheels.

* * * * *